United States Patent [19]

Richards

[11] 4,218,784

[45] Aug. 26, 1980

[54] DUAL-PURPOSE DIVERTER VALVE

[76] Inventor: Gary Richards, 3204 Palm Ave., Manhattan Beach, Calif. 90266

[21] Appl. No.: 33,164

[22] Filed: Apr. 25, 1979

[51] Int. Cl.[2] ..... A47K 3/10; A47K 3/00; A47K 3/09

[52] U.S. Cl. ..... 4/543

[58] Field of Search ..... 4/180, 172.19, 172

[56] References Cited

U.S. PATENT DOCUMENTS

| | | | |
|---|---|---|---|
| 2,856,611 | 10/1958 | Velonis | 4/180 |
| 3,108,289 | 10/1963 | Smith | 4/213 |
| 4,166,296 | 9/1979 | Darrah et al. | 4/172 |

*Primary Examiner*—Henry K. Artis
*Attorney, Agent, or Firm*—Francis X. LoJacono

[57] ABSTRACT

A dual-purpose diverter valve designed particularly to be incorporated within an air-pressure system associated with hot spas, tubs and the like, wherein air is pumped into the tub water to create a massaging action therein, the diverter valve comprising an enlarged cylindrical housing having an inlet port and an oppositely disposed outlet port, the inlet port being connected to the air-pump side and the outlet port being connected to the tub side; and wherein the housing thereof defines a transitory chamber in which there is provided a dual-valve arrangement, the dual valve being formed between the inlet port and a back-flow-vent port, the inlet port including an inwardly protruding angular-valve set having a flexible valve-flap member adapted to close the inlet passage when air is not being pumped to the tub, and wherein the flap-valve member is arranged to disengage from the inlet-passage valve set and engage the back-flow-vent port, thereby closing the vent port during air flow through the chamber.

5 Claims, 3 Drawing Figures

DUAL-PURPOSE DIVERTER VALVE

BACKGROUND OF THE INVENTION

1. Field of the Invention

This invention relates generally to diverter-valve devices, and more particularly to a diverter valve designed to control the flow of gas in one direction and the flow of liquid in the opposite direction.

2. Description of the Prior Art

As is well known in the art, various problems and difficulties are encountered in providing suitable means for controlling the air and water flow within the pumping systems of spas, tubs, or other types of bathing facilities, wherein air is pumped into the water of the units to provide a massaging action within the water. Generally, the water will have a tendency to flow into the air conduits leading to the pumping mechanism. Due to the different installing methods and arrangements of the conduits and pipes, there is always a chance that the back-flow of water will reach critical parts of the system. Thus, there is a need for a simple device that will allow the air to be freely forced under pressure through the conduits to the tub, and yet prevent the back-flow of tub water from reaching the downstream pumping mechanism.

SUMMARY OF THE INVENTION

Accordingly, the present dual-purpose check valve is so designed as to freely allow air flow under pressure to reach and discharge, as required, into the spa or tub unit; and it is further arranged to close the downstream air conduits to any back-flow of water when the pressure system is closed down or shut off, whereby any back-flow thereof would be vented through a back-flow vent discharging the water to atmosphere outside the air-pressure system.

Hence, the present invention has for an important object a dual-acting-valve flap which actuates between an inlet-port valve and an outlet-vent port, the valve flap being operably located in a transitory chamber through which air pressure transfers from an air-pressure system to the tub in one direction, and prevents back-flow of water passing therethrough by allowing the water to freely discharge through the vent port.

It is another object of the invention to provide a dual-purpose check valve that includes a simple flap-valve member that actuates between the inlet port and the vent port, and is arranged to engage each respective port during and after the operation of the air-pressure system.

It is still another object of the invention to allow flow of air under pressure in one direction, and allow liquid to flow in the opposite direction without entering the downstream air conduits.

It is a further object of the invention to provide a check valve of this type that has relatively few operating parts.

It is still a further object of the invention to provide a device of this character that is easy to service and maintain.

Still another object of the invention is to provide a device of this character that is relatively inexpensive to manufacture, and is simple and rugged in construction.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only.

DESCRIPTION OF THE PREFERRED EMBODIMENT

Figure 1:
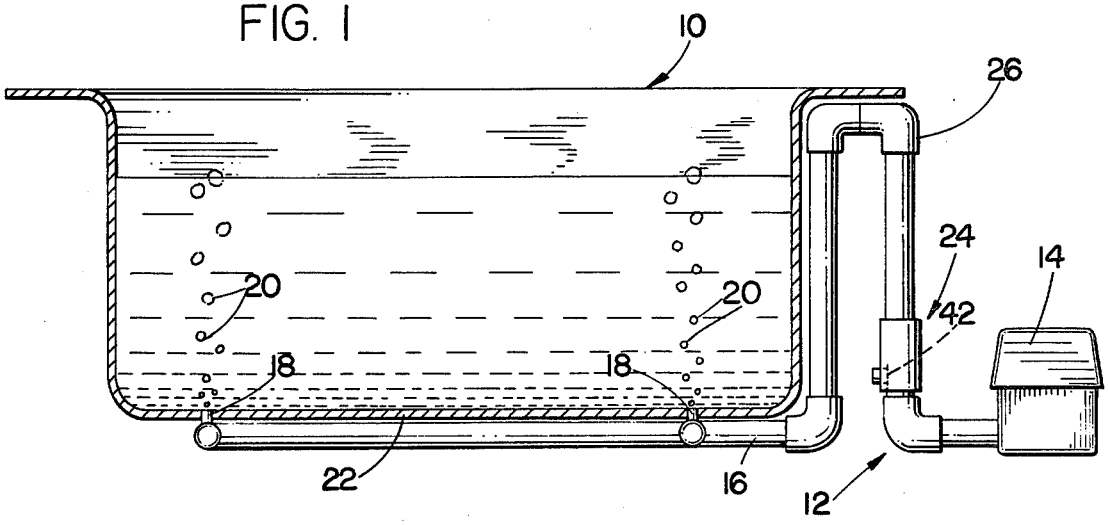
FIG. 1 is a cross-sectional view of a tub having water stored therein, and showing an air-pressure system including the present invention within the system.

Referring more particularly to FIG. 1, there is shown a tub unit, generally indicated at 10, this tub representing any of the known type spas, tubs or swimming pools that incorporate an air-pressure system, as indicated as 12. Because the present device is used in combination with an air-pressure system, only that system is shown and referred to—since the water, heating and filtering systems are well known, and not directly related to the present invention.

As is well understood in the art, tub units such as 10 are adapted to have hot water recirculated therein and, in addition, are equipped with an air-pressure-supply system 12 which provides a continuous flow of agitated water that acts as a massaging means to individuals within the tub or pool.

Accordingly, the air-pressure system includes an air pump 14 having a conduit or a plurality of conduits 16 that are provided with several pressure-outlet nozzles 18 that discharge air 20 under pressure within the tub at selected locations, as seen in FIG. 1 entering from the bottom wall 22 of tub 10.

Thus, when the air system is turned off, a problem occasionally arises when water from the tub will back-flow through the conduits, with a chance of reaching air pump 14. In order to prevent such an occurrence of water reaching pump 14, a dual-purpose check valve, generally indicated at 24 has been devised, as herein disclosed. Said dual-purpose-diverter valve 24 is positioned downstream of the discharge nozzles 18, and preferably at a location between the pump and the conduit-riser section 26, the check valve being preferably positioned vertically in the conduit system. Although, the check valve will operate in a horizontal mode, a more positive action results when arranged as indicated in the drawings.

The dual-purpose-diverter valve 24 comprises a cylindrical housing 30 which defines a transitory chamber 32, said housing including at each respective opposite end thereof an outlet port 34 and an inlet port 36. Outlet port 34 is secured to conduits 16, which will be referred to as the downstream side; and inlet port 36 is connected to the upstream side of the conduits 16. Included within the annular wall 38 of housing 30 is a back-flow vent port 40 which is positioned adjacent to and at right angles to inlet port 36.

Figure 2:
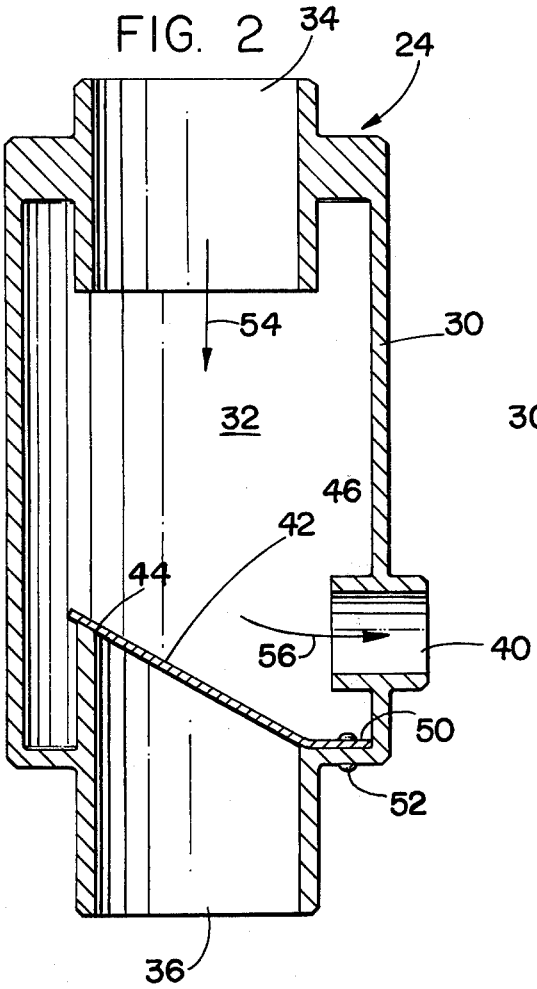
FIG. 2 is an enlarged cross-sectional view of the dual-purpose-diverter-valve device wherein the valve-flap member is shown set against the inlet-port-valve set.
Figure 3:
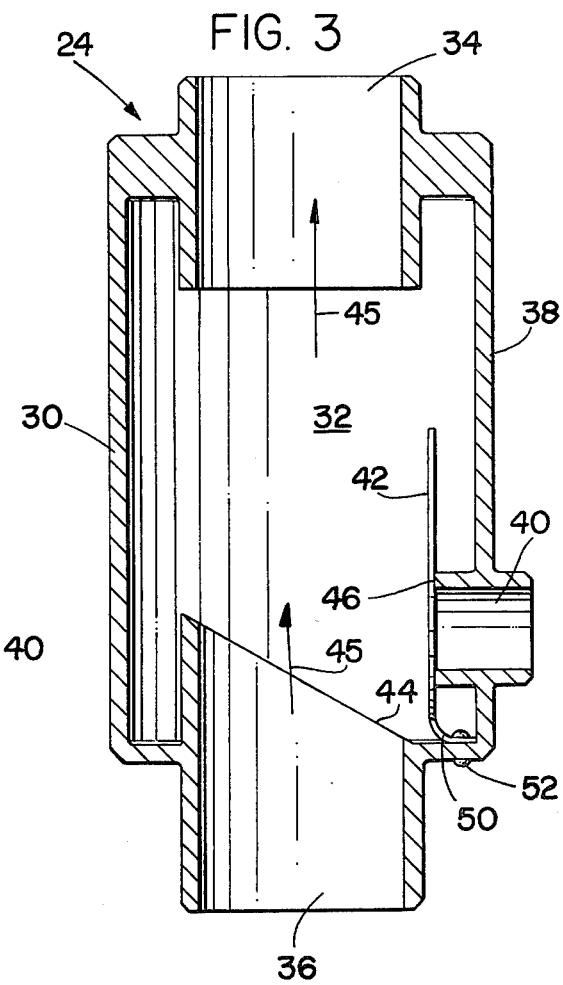
FIG. 3 is a similar cross-sectional view thereof, with the valve-flap member forced against the back-flow-vent port.

Pivotally attached within the housing 30 is a flap valve member 42 which is set against the inlet-port-valve set 44 in a normally closed mode, when the system is closed down. (See FIG. 2.) However, when air pump 14 is activated, air pressure is forced through transitory chamber 32 from inlet port 36 to outlet port 34 in the direction of arrows 45, the pressure at this time lifts flap valve 42 to an upright position, as seen in FIG. 3. The force passing through inlet port 36 causes flap valve 42 to set against the inner valve set 46 of the back-flow vent 40. Thus, the pressurized air readily traverses through chamber 32 into the downstream conduits 16, without venting to atmosphere through vent 40 which is closed at that time.

To aid in the sealing or closing of inlet valve set 44, valve set 44 is angularly disposed at approximately 45° with respect to vent-valve set 46. This angular position also shortens the pivotal rotational movement of flap valve 42, whereby a simple pivoting means can be employed therein. It is contemplated that various pivoting connections can be employed with the flap valve 42; and thus, as an example, flap valve 42 is shown having a flexible extended lip member 50 secured to housing 30 by a pin 52.

At the time air pump 14 is shut off, flap valve 42 will return to the angular valve set 44, thereby closing and preventing any back-flow through inlet port 36. Accordingly, when water passes into conduits 16 and enters chamber 32—as indicated by arrow 54 in FIG. 2—the water will be allowed to discharge through back-flow vent 40, indicated by arrow 56.

Thus, during the operation of the air-pump system, flap valve 42 serves the purpose of allowing pressurized air to traverse through chamber 32, and preventing the air from passing through vent 40. When the system is turned off, flap-valve 42 prevents water back-flow from entering the upstream side of the valve, and allows the water in chamber 32 to discharge to atmosphere through the open vent 40.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and I do not wish to be restricted to the specific form shown or uses mentioned, except as defined in the accompanying claims.

I claim:

1. A diverter-valve device in association with an air-pressure system adapted for use with a hot-tub-spa unit, or the like, having conduit and discharge nozzles connected to said tub unit, comprising:

a housing having an inlet port and an outlet port oppositely disposed to each other, said inlet port being connected to the upstream side of said air-pressure system adjacent said pump, and said outlet port being connected to said downstream side of said air-pressure system, whereby pressurized air flow is allowed to flow through said conduits and be discharged into said tub;

a transitory chamber defined by said housing and interposed between said inlet and outlet ports for air-flow communication therebetween;

an inlet-valve set formed as part of said inlet port and positioned within said chamber;

a back-flow vent disposed in said housing adjacent said inlet port, and arranged at right angles thereto to provide communication between said chamber and atmosphere, whereby said inlet-valve set is angularly disposed relative to said backflow vent;

a vent-valve set formed as part of said back-flow vent and positioned within said chamber; and a flap-valve member operably disposed between said inlet-valve set and said vent-valve set, so as to engage and close said inlet port when said air-pressure system is shut down, and to engage and close said back-flow vent when said air-pressure system is operational.

2. A diverter-valve device as recited in claim 1, wherein said valve device is mounted in a vertical position within said air-pressure system intermediate said nozzles and the air pump of said system.

3. A diverter-valve device as recited in claim 1, wherein the angular displacement of said inlet-valve set is disposed at approximately 45° with respect to said vent port.

4. A diverter valve as recited in claim 3, wherein said flap valve includes a means to pivot said flap-valve between said inlet-valve set and said vent-valve set.

5. A diverter valve as recited in claim 3, wherein said pivot means comprises:

an extended lip member attached to said housing; and a pin securing said lip member to said housing.

* * * * *